United States Patent [19]

Murray et al.

[11] 4,176,465

[45] Dec. 4, 1979

[54] HEAT SAVING METHOD FOR DRYING WET SOLIDS

[75] Inventors: Robert G. Murray, Palo Alto; Benjamin J. Gikis, Los Altos Hills, both of Calif.

[73] Assignee: Natomas Company, San Francisco, Calif.

[21] Appl. No.: 816,497

[22] Filed: Jul. 18, 1977

[51] Int. Cl.[2] ..... F26B 3/24

[52] U.S. Cl. ..... 34/31; 34/36; 34/182; 34/242; 208/11 LE

[58] Field of Search ..... 34/182, 183, 242, 31, 34/219, 75; 208/11, 11 LE

[56] References Cited

U.S. PATENT DOCUMENTS

| | | | |
|---|---|---|---|
| 617,712 | 1/1899 | Bell | 196/14.52 |
| 3,161,581 | 12/1964 | Tiedge et al. | 196/14.52 |
| 3,984,287 | 10/1976 | Meadus et al. | 208/11 E |

*Primary Examiner*—Benjamin R. Padgett
*Assistant Examiner*—J. L. Barr
*Attorney, Agent, or Firm*—Edward B. Gregg

[57] ABSTRACT

A heat saving method for drying wet particulate solids as the latter move upwardly in a loaded screw flight conveyer wherein, by establishing a non-condensable gas barrier at the upper end of the flight, the vapors formed by heating the upwardly moving mass are induced to flow downwardly for condensation by the cooler incoming particulate matter, thereby effecting an internal transfer of the heat of vaporization of the wetting liquid and a consequent reduction in the heat required to dry the particulate matter and recover the separated vapor in liquid form.

4 Claims, 1 Drawing Figure

HEAT SAVING METHOD FOR DRYING WET SOLIDS

BACKGROUND OF THE INVENTION

Figure 1:
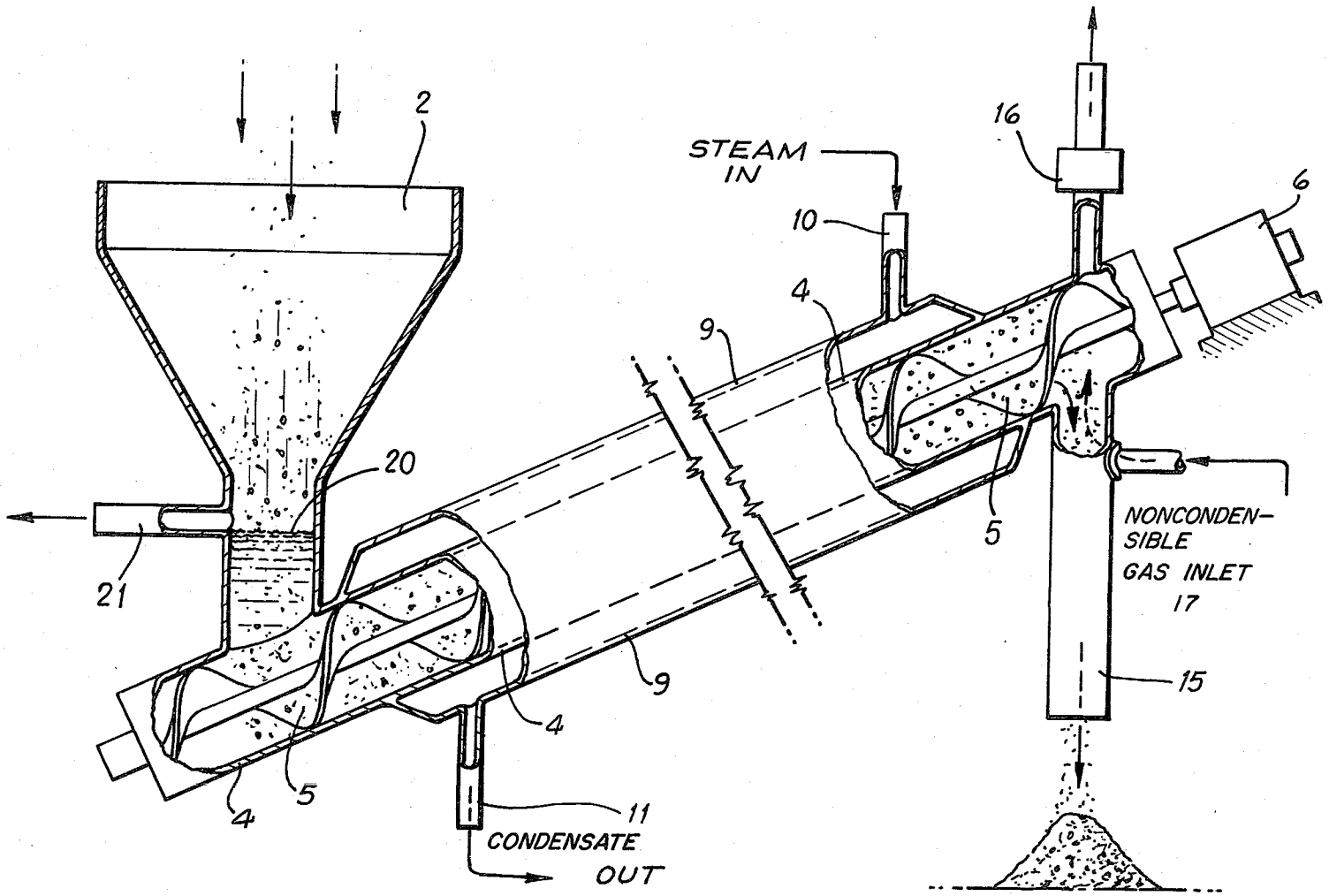

The method hitherto employed for drying granular solids in an inclined heated screw flight conveyer consists of introducing the wet solids at the lower end and withdrawing a mixture of hot dry solids and vaporized liquid at the opposite end, the heat necessary to vaporization being usually transferred through the conveyor walls, though transfer through an internally heated screw flight is also possible. The heat required to accomplish the drying of the solid material consists of the sensible heat needed to raise both solid and liquid to the discharge temperature, plus the heat of vaporization of the liquid. In addition, if it is desired to recover the separated vapor in liquid form, the heat of condensation would have to be removed requiring additional heat exchange equipment.

It is an object of this invention to reduce the heat required to dry the particulated material and to recover the separated vapor in condensed liquid form. The nature of other objects of the invention will be apparent from a consideration of the descriptive portion to follow.

SUMMARY OF THE INVENTION

The present invention fulfills the foregoing heat-saving object by providing a method and apparatus for drying wet particulate solids as the latter move upwardly in a loaded screw flight conveyer wherein, by establishing a non-condensable gas barrier at the upper end of the flight, the vapors formed by heating the upwardly moving mass are induced to flow downwardly for condensation by the cooler incoming particulate matter, thereby effecting an internal transfer of the heat of vaporization of the wetting liquid and a consequent reduction in the heat required to dry the particulate matter and recover the separated vapor in liquid form.

The nature of the present invention will be clearly understood by reference to the figure of the drawing which represents a diagramatic view in elevation of apparatus adapted to a practice of the present invention.

Referring more particularly to the drawing, wet granular solids are introduced into a feed hopper 2 where they are in position to be carried up an inclined tube indicated at 4 by means of a rotating screw flight 5 driven by motor 6. The fit of said flight within tube 4 and the steep incline of the unit is such as to cause the screw flight to operate completely filled with particulate matter. The upper portion of tube 4 is heated by a steam jacket 9 into which steam is introduced through pipe 10. Condensate is removed via pipe 11. The heat introduced into tube 4 and its contents causes vaporization of the liquid present in the upper portion of said tube. These vapors are prevented from exiting at the upper end of tube 4 by maintaining a body of an non-condensable gas (e.g., nitrogen) in said end portion. This is accomplished by connecting line 17 to a source of the said gas, under slight pressure, typically about 0.5 to 2 psi. The presence of this non-condensable gas creates a barrier to the upward flow of the vapor formed in tube 4, thus preventing essentially all of said vapor from leaving the system along with the dry particulate material through pipe 15. In the presence of the added gas, the solvent vapor being generated tends to increase the internal pressure in the upper end of inclined tube 4, thus causing the vapor to flow downwardly where it condenses on the cooler incoming particulate matter. Any vapor which does diffuse into the upper end of the inclined tube will raise the gas pressure sufficiently to activate pressure relief valve 16, the gases so discharged being sent to a condenser (not shown).

Loss of the non-condensable gas through solids outlet pipe 15 can be minimized by keeping said pipe filled with the dried solid particles over an appreciable portion of its length. Alternatively, a solids discharge valve (not shown) can be inserted in pipe 15 to preserve system pressures.

Both the vapor and the noncondensable gases are prevented from escaping from the lower end of inclined tube 4 both by action of the particulate matter traveling upward through the tube and by the accumulation of liquid in the feed hopper 2 which rises to level 20. Excess liquid is drawn off through pipe 21.

The present invention is of particular utility in connection with methods for the solvent extraction of particulate tar sands. In such operations the large amounts of sands separated from the bitumen content of the tar sand are wet with the solvent, and the same must be recovered in the most economic methods available if the process is to be operated commercially. Thus the wet granular solids entering the hopper 2 may be tar sand that has been extracted with a hydrocarbon, i.e., an aromatic solvent such as benzene, toluene, or a mixture of aromatic hydrocarbons, to dissolve the tar. The material entering the hopper and dried in tube 4 is wet sand, the wetting liquid being such solvent containing dissolved tar. In such a system, the bulk of the solvent containing dissolved tar will have been removed upstream from the hopper 2. The tar solution withdrawn at 21 will be evaporated to produce an increment of tar and to recover the solvent. Suitable apparatus and process for extracting the tar and separating the residual sand are described in our copending application, Ser. No. 816,506, filed July 18, 1977, now U.S. Pat. No. 4,120,775 dated Oct. 17, 1978, filed concurrently with this application and entitled "PROCESS AND APPARATUS FOR SEPARATING COARSE SAND PARTICLES AND RECOVERING BITUMEN FROM TAR SANDS."

What is claimed is:

1. In a method for drying wet particulate matter continuously moving upwardly in a screw flight conveyer loaded with said matter which is being heated to vaporize the liquid wetting the particles, the improvement leading to heat savings which comprises maintaining a non-condensable gas barrier at the upper end of the screw flight whereby the vapors formed by heating the wetting liquid are blocked from leaving the flight at said end and whereby said blocked vapors are induced to flow downwardly through the upcoming particulate matter for condensation by the incoming, cooler, wet particulate matter present in the lower end of the screw flight, thereby effecting an internal transfer of the heat of vaporization of the wetting liquid and a consequent reduction in the heat required to dry the particulate matter.

2. The method of claim 1 wherein the non-condensable gas barrier at the upper end of the screw flight is nitrogen maintained under slightly elevated pressure.

3. The method of claim 1 wherein the said particulate material is tar sand from which the tar has been extracted by a tar solvent and such sand is wetted by such solvent containing dissolved tar.

4. Apparatus for drying wet particulate material comprising:

(a) an inclined screw flight conveyer having a lower end and an upper end, (b) inlet means joined to said lower end for gravity feed of wet particulate matter to the lower end of the conveyer, (c) liquid outlet means associated with said inlet means allowing outflow of liquid therefrom above the junction of said inlet means and the lower end of said conduit, (d) means for heating the contents of said conveyer to vaporize the liquid component of the wet particulate material, (e) outlet means at the upper end of said conveyer for outflow of dry particulate material by gravity, and (f) means for maintaining a body of non-condensable gas at the upper end of the conveyer to block outflow of vapor of the wetting liquid from the said upper end.

* * * * *